US009305733B2

(12) United States Patent
Rand et al.

(10) Patent No.: US 9,305,733 B2
(45) Date of Patent: Apr. 5, 2016

(54) 12CAO-7AL2O3 ELECTRIDE HOLLOW CATHODE

(71) Applicant: COLORADO STATE UNIVERSITY RESEARCH FOUNDATION, Fort Collins, CO (US)

(72) Inventors: Lauren P. Rand, Waltham, MA (US); John D. Williams, Fort Collins, CO (US); Rafael A. Martinez, Fort Collins, CO (US)

(73) Assignee: Colorado State University Research Foundation, Fort Collins, CO (US)

( * ) Notice: Subject to any disclaimer, the term of this patent is extended or adjusted under 35 U.S.C. 154(b) by 0 days.

(21) Appl. No.: 14/263,970

(22) Filed: Apr. 28, 2014

(65) Prior Publication Data

US 2014/0354138 A1 Dec. 4, 2014

Related U.S. Application Data

(60) Provisional application No. 61/816,593, filed on Apr. 26, 2013.

(51) Int. Cl.

| | |
|---|---|
| ***H01J 1/14*** | (2006.01) |
| ***H01J 27/14*** | (2006.01) |
| ***H01J 1/02*** | (2006.01) |
| ***H01J 27/08*** | (2006.01) |

(52) U.S. Cl.

CPC ..... *H01J 1/025* (2013.01); *H01J 27/08* (2013.01); *H01J 27/146* (2013.01); *H01J 1/14* (2013.01)

(58) Field of Classification Search

CPC ..... H01J 1/025; H01J 27/00–27/26
USPC ..... 313/231.01–231.71, 633, 153, 346 R, 313/618, 339

See application file for complete search history.

(56) References Cited

U.S. PATENT DOCUMENTS

| | | | | |
|---|---|---|---|---|
| 2,894,054 | A | 7/1959 | Cameron et al. | |
| 5,241,243 | A * | 8/1993 | Cirri | 313/231.31 |
| 5,970,993 | A | 10/1999 | Witherspoon et al. | |
| 6,427,757 | B1 | 8/2002 | Tilak | |
| 2005/0061657 | A1 | 3/2005 | Hosono et al. | |
| 2009/0224214 | A1 * | 9/2009 | Hosono et al. | 252/519.1 |
| 2011/0155970 | A1 * | 6/2011 | Ito et al. | 252/519.14 |
| 2012/0001539 | A1 | 1/2012 | Rueger et al. | |
| 2013/0088141 | A1 | 4/2013 | Miyakawa et al. | |

OTHER PUBLICATIONS

International Searching Authority, International Search Report, Sep. 26, 2014, PCT/US14/35747, pp. 1-11.

(Continued)

*Primary Examiner* — Mariceli Santiago
(74) *Attorney, Agent, or Firm* — Samuel M. Freund; Cochran Freund & Young, LLC

(57) ABSTRACT

The use of the electride form of $12CaO\text{-}7Al_2O_3$, or C12A7, as a low work function electron emitter in a hollow cathode discharge apparatus is described. No heater is required to initiate operation of the present cathode, as is necessary for traditional hollow cathode devices. Because C12A7 has a fully oxidized lattice structure, exposure to oxygen does not degrade the electride. The electride was surrounded by a graphite liner since it was found that the C12A7 electride converts to it's eutectic (CA+C3A) form when heated (through natural hollow cathode operation) in a metal tube.

35 Claims, 11 Drawing Sheets

(56) References Cited

OTHER PUBLICATIONS

Rand et al., "C12A7 Electride Hollow Cathode", Conference Paper, DTIC Online Information for the Defence Community, pp. 1-8, Mar. 2013.

Domonkos et al., "Parametric Investigation of Orifice Aspect-Ratio on Low Current Hollow Cathode Power Consumption", American Institute of Aeronautics, pp. 1-10, 1998.

Goebel et al., "Chapter 6: Hollow Cathodes", Apr. 17, 2008, pp. 243-323.

* cited by examiner

12CAO-7AL2O3 ELECTRIDE HOLLOW CATHODE

CROSS-REFERENCE TO RELATED APPLICATIONS

The present application claims the benefit of U.S. Provisional Patent Application No. 61/816,593 for "C12A7 Electride Hollow Cathode," by Lauren P. Rand et al., which was filed on 26 Apr. 2013, the contents of which application is hereby specifically incorporated by reference herein for all that it discloses and teaches.

STATEMENT REGARDING FEDERAL RIGHTS

This invention was made with government support under Grant No. FA9300-06-C-0023 awarded by the Air Force Electronic Systems Center, NNG05GH75H awarded by the NASA Goddard Space Flight Center and NNX11CD35P awarded by the NASA Lyndon B. Johnson Space Center. The government has certain rights in the invention.

FIELD OF THE INVENTION

The present invention relates generally to hollow cathode discharge apparatus and, more particularly to the use of $12CaO\text{-}7Al_2O_3$ electride material as a low work function electron emitter in a hollow cathode discharge apparatus.

BACKGROUND OF THE INVENTION

Hollow cathodes are the primary electron source in space propulsion applications, as well as in many ground-based devices such as gaseous lasers and plasma processing sources. They are often preferable to filament sources due to their increased robustness and lifetime. Hollow cathodes are cylindrical in shape, and consist of an orificed tube with a low work function material along the inner surface. See, e.g., Goebel, D. M., and Katz, I. (2008), *Fundamentals of Electric Propulsion: Ion and Hall Thrusters*, New York: Wiley; and Polk, J. et al. (2006, Jul. 9-12), "Characterization of Hollow Cathode Performance and Thermal Behavior," AIAA-2006-5150, Sacramento, Calif. The ease with which the electrons are emitted from the insert is related to the work function of the material. See, e.g., Coulombe, S, and Meunier, J.-L (1997), "Thermo-field emission: a comparative study," J. Phys. D: Appl. Phys., 30, 776-780; Murphy, E. L. and Good, R. H. (1956), "Thermionic Emission, Field Emission, and the Transition Region," Physical Review, 102, 1464-1471; and Parlini, J. et al. (1993), "Thermo-field emission and the Nottingham effect," Journal of Physics D: Applied Physics, 26, 1310. Lower work function indicates equivalent emission can be obtained at lower temperatures, improving the power efficiency because lower temperature cathodes lose less heat. A low temperature cathode has the potential to be extremely efficient and could be fabricated from inexpensive materials instead of refractory metals.

The calcium aluminate phase of $12CaO\text{-}7Al_2O_3$ (C12A7), is one of several alumina-lime phases found in common alumina-based cements. C12A7 has a naturally formed nanostructure, in which subnanometer-sized cages form a three-dimensional crystal lattice. See, e.g., Y. Toda et al. (2007), "Work Function of a Room-Temperature, Stable Electride [Ca24Al28O64]4+(e−)4," Advanced Materials, 19(21), 3564-3569. The unit cell consists of twelve cages. Although this cage structure is similar to those found in clathrate phases of ice and in zeolites, there is a difference in that the unit cell of C12A7 is positively charged; that is, there are four fewer electrons on the atoms that comprise the framework cage of C12A7 than are needed to neutralize the cage. The positive charge is counteracted by two atomic oxygen ions ($O^{2-}$) that are clathrated (floating) within two of the twelve subcages. New properties can be imparted to C12A7 if the free oxygen ions are substituted with anions like $O^-$ and $H^-$, and when four electrons are substituted for the two $O^{2-}$ ions to form C12A7 electride, the only inorganic electride known to be stable at high temperature. See e.g., S. Matsuishi et al. (2003), "High-Density Electron Anions in a Nanoporous Single Crystal: [Ca24Al28O64]4+(4e−). Science, 301, 626-629; and S. Kim et al. (2007)," "Fabrication of room temperature-stable 12CaO 7Al2O3 electride: a review," Journal of Material Science, 18, S5-S14. The stability of the C12A7 electride is attributable to the unique cage structure as well as the fully oxidized nature of the lattice.

The work functions of current state-of-the-art hollow cathode insert materials lanthanum hexaboride ($LaB_6$) and cerium hexaboride ($CeB_6$) are near 2.7 eV, while the work function of barium-impregnated porous tungsten (Ba—W) is near 2.1 eV (D. Goebel et al. (2007), "LaB6 Hollow Cathodes for Ion and Hall Thrusters," Journal of Propulsion and Power," 23(3), 552-558. $LaB_6$ and $CeB_6$ are generally heated to approximately 1900 K to obtain sufficient levels of emission, while Ba—W is heated above 1300 K. See e.g., D. Goebel et al., supra. These temperatures require well-made heaters and good thermal insulation. Ba—W cathodes, while operating at lower temperatures, are more susceptible to both poisoning and high rates of evaporation if operated at high current See. e.g., D. Goebel et al., supra. By contrast, the work function of C12A7 electride has been measured in field emission tests to be as low as 0.6 eV, due to its unique charged lattice structure. See, e.g., S. Kim et al. (2006), "Synthesis of a Room Temperature Stable 12CaO.7Al2O3 Electride from the Melt and Its Application as an Electron Field Emitter," Chem. Mater., 18(7), 1938-1944; and J. E. Medvedeva et al. (2007), "Electronic band structure and carrier effective mass in calcium aluminates, Physical Review B, 76, 155107-1-155107-6; and Y. Toda et al. (2004), "Field Emission of Electron Anions Clathrated in Subnanometer-Sized Cages in [Ca24Al28O64]4+(4e−)," Advanced Materials, 16(8), 685-689.

SUMMARY OF THE INVENTION

Embodiments of the present invention overcome the disadvantages and limitations of prior art by providing a hollow cathode discharge apparatus which does not require an external heater.

Another object of embodiments of the present invention is to provide a hollow cathode discharge apparatus which does not require an external heater, and which is resistant to degradation when exposed to oxygen relative to state of the art hollow cathodes.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

To achieve the foregoing and other objects, and in accordance with the purposes of embodiments of the present invention, as embodied and broadly described herein, the hollow cathode discharge apparatus, hereof, includes: a metal tube having a first end and a second end, an outside surface and an inside surface; a gas source for flowing gas into the first end of the tube; a metal end cap having an orifice with a chosen diameter adapted to attach to the second end of the tube, such that the gas exits the tube through the orifice; a tubular graphite liner having an outer surface, a first open end and a second end, adapted to be inserted into the metal tube, and in electrical contact therewith, with the second end thereof disposed in the vicinity of the end cap; a $12CaO\text{-}7Al_2O_3$ electride material disposed inside of the tubular graphite liner in the vicinity of the metal end cap; a keeper element disposed outside of the tube in the vicinity of the end cap; and a first direct current source in electrical contact with the keeper and the tube for initiating and maintaining an electric discharge in the gas between the electride material and the keeper without the electride material being initially heated.

In another aspect of the present invention and in accordance with its objects and purposes, the hollow cathode discharge apparatus, hereof, includes: a metal tube having a first end and a second end, an outside surface and an inside surface; a gas source for flowing gas into the first end of the tube; a metal end cap having an orifice with a chosen diameter adapted to attach to the second end of the tube, such that the gas exits the tube through the orifice; a tubular graphite liner having a first closed end and a second open end adapted to be inserted into the metal tube such that gas can flow between the graphite liner and the inside surface of the metal tube, the second end of the insert being disposed in the vicinity of the end cap; wherein the metal tube is dimpled in the region of the first end of the graphite liner for holding the liner in position in the tube, and for making electrical contact therewith; a $12CaO\text{-}7Al_2O_3$ electride material generated in the tubular graphite liner and filling the insert to about the second end thereof; a keeper element disposed outside of the tube in the vicinity of the end cap; and a first direct current source in electrical contact with the keeper and the tube for initiating and maintaining an electric discharge in the gas between the electride material and the keeper without the electride material being initially heated.

Benefits and advantages of the present invention include, but are not limited to, providing a hollow cathode discharge apparatus which does not require an external heating element, and has a low work function electron emitter material which resists degradation in the presence of oxygen and other gases.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 1*a* is a schematic representation of a side view of an embodiment of the hollow cathode apparatus of the present invention illustrating the cathode barrel, graphite liner and keeper, while

DETAILED DESCRIPTION OF THE INVENTION

Figure 1A:
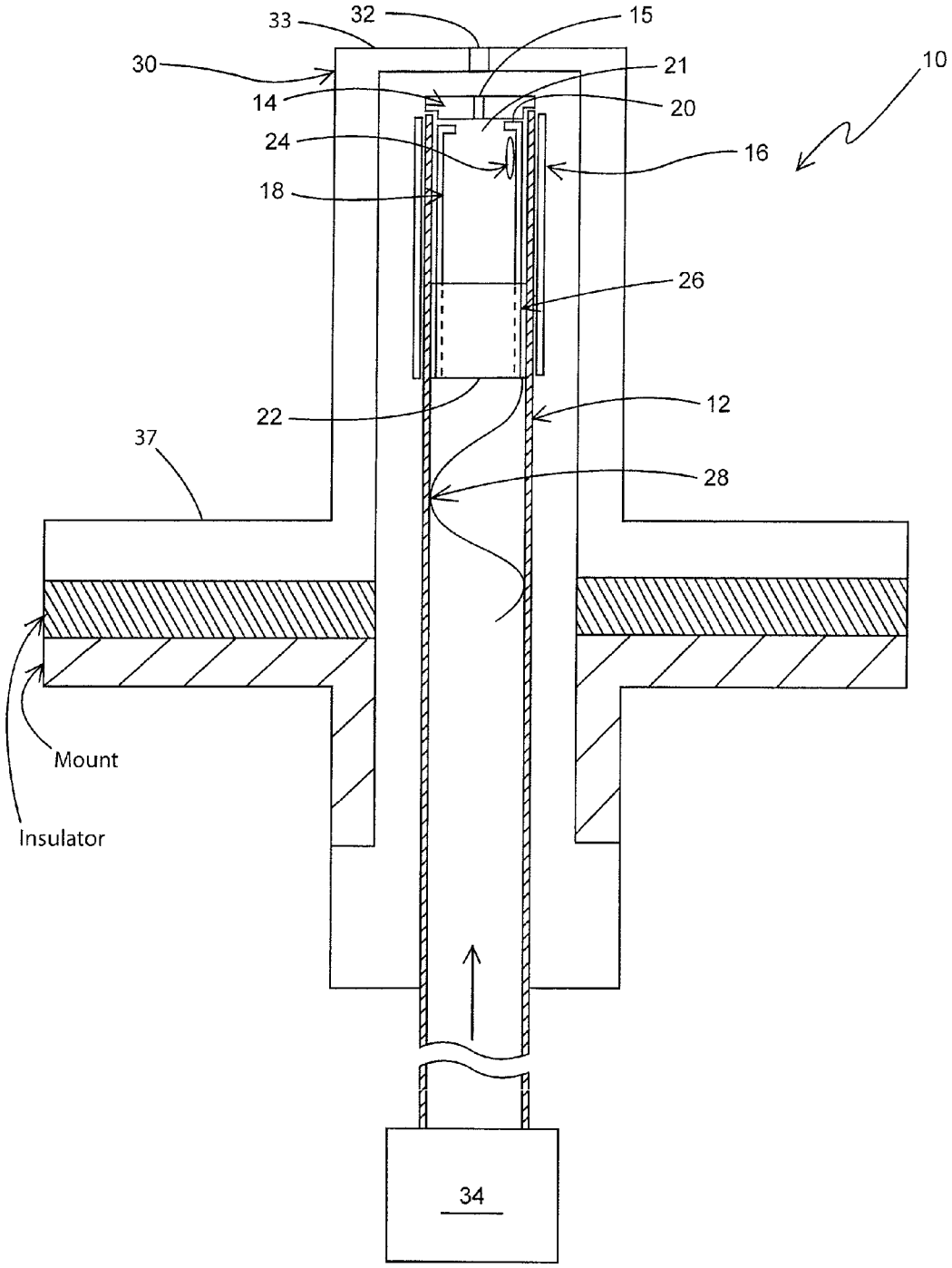

Embodiments of the present invention include the use of the electride form of $12CaO\text{-}7Al_2O_3$, or C12A7, as a low work function electron emitter in a hollow cathode discharge apparatus. The low work function of C12A7 electride derives from its unique structure, and permits a C12A7 cathode to operate theoretically at ~400 K. No heater is required for initiating the operation of the cathode, as is necessary for traditional hollow cathode devices, thereby eliminating these components and reducing the weight of fieldable hollow cathode devices.

Without the need for a heater the hollow cathodes of the present invention can be significantly smaller in diameter when compared to existing cathodes. Additionally, cathodes capable of providing small current emission (≤100 mA) may be fabricated for micro-propulsion applications since electride electron emitters emit at lower temperatures than traditional emitters. In fact, 1/16 in. cathodes are anticipated in accordance with the teachings of the present invention.

In the assembly of the hollow cathode apparatus hereof, a sliver of C12A7 electride is placed into a graphite tube. When small hollow cathodes having outside diameters ≤3.5 mm are desired, a graphite cup used also to prepare the electride, as will be described hereinbelow, was placed within the hollow cathode with the open end of the cup placed near to the orifice of the hollow cathode. In both embodiments, graphite was used since it was found that the C12A7 electride would convert to its eutectic (CA+C3A) form when heated (through natural hollow cathode operation) in a metal (tantalum) tube. The graphite provides an anionic template, as it does during the original C12A7 formation process, as also will be described hereinbelow.

A. Preparation of C12A7 Electride:

Two precursors ($CaCO_3$ and $Al_2O_3$) were mixed in a 12:7 stoichiometric ratio and ground with a mortar and pestle to reduce the particle size and help facilitate a solid-state reaction. The powders used were 150 Mesh Type 507C aluminum oxide from Sigma Aldrich and 99.9% pure calcium carbonate from Fisher Scientific. The mixture was placed in a graphite crucible, fabricated from EDM-3 fine-grained graphite obtained from Ohio Carbon Blank, Inc. The carbon crucible was found to be necessary for the successful formation of C12A7 electride. Although the exact mechanism is unknown, it is thought that the carbon crucible is needed to supply carbon anions to occupy the subcages and permit the formation of the lattice, which then evacuate upon cooling leaving behind their electrons (S. Kim et al., supra). A graphite plate was secured over the top of the crucible with tantalum wire to keep the molten precursors from flowing out of the crucible during the heating process due to surface tension.

The furnace and crucible were placed in a vacuum chamber, and the temperature raised to 1700° C. over the course of about 2 h, at which point the furnace power was abruptly turned off and the furnace and crucible were allowed to cool radiatively to the water-cooled vacuum chamber walls. The crucible cooled to below the recrystallization temperature of about 1000° C. in less than 30 min. The chamber was generally not vented for at least 16 h after the power supply had been shut off, in order to give the furnace and crucible time to cool before exposure to atmosphere. As an alternative, the electride could be cooled more rapidly, limited by undesirable fracturing of the material, by introducing an inert gas into the furnace, thereby permitting convective cooling to occur. The resulting electride was metallic-looking, conductive, and bonded to the graphite. Positive identification was obtained using EPR, x-ray photoelectron spectroscopy (XPS), and x-ray diffraction crystallography (XRD). Using a diamond-coated blade, slivers consisting almost entirely of C12A7 electride were cut from the graphite crucible for use in the hollow cathode, as will be described hereinbelow. The resulting pieces were approximately 1.9 mm wide and 12.7 mm long. Because C12A7 electride has a fully oxidized lattice structure, exposure to oxygen and other gases present in laboratory air were found not to have a deleterious effect on the cathode.

In the second embodiment, electride-filled cups about 6 mm long having outer diameters of about 2.6 mm, inner diameters of about 2 mm, and a 5 mm long hollow cavity, were generated. As will be discussed in more detail hereinbelow, these cups with electride filling were placed inside Ta hollow cathodes with the electride filling placed in the vicinity of a Ta orifice plate.

B. Hollow Cathode:

Initial electride hollow cathode prototypes utilized a graphite hollow cathode tube with an orifice plate at one end thereof. This was done because the electride could be melted directly on the inner surface of the graphite hollow cathode tube. The precursors were mixed and put directly in the tube, and the entire tube was then placed in the vacuum furnace and heated according to the procedure described hereinabove. The resulting cathode typically had several solidified electride droplets attached to the graphite at uncontrollable intervals along the inside of the barrel, with the electride droplet furthest downstream often being as much as 1.27 cm upstream of the orifice end of the tube. Since models predict that the majority of electron emission in a hollow cathode will occur in the first few millimeters of the insert, the upstream position of the electride was much less effective. The resulting operation was unstable with the discharge often extinguishing. Anode voltage was observed to vary, perhaps, due in part to the dominant emission site changing between the multiple electride droplets. Additionally graphite is susceptible to arcing, which occurred frequently and eventually resulted in severe erosion of the orifice plate.

To improve the stability of the cathode and decrease arcing, a tantalum tube was used in place of the graphite barrel. The tantalum barrel was capped with a thoriated tungsten orifice plate having an orifice. Rather than melt the electride precursors directly onto the inner surface of the barrel, the precursors were heated in a graphite crucible, and the resulting electride was broken into pieces. Several pieces were inserted into the tantalum tube near the thoriated tungsten orifice plate, with the result that the discharge could be run for greater than seven hours. The operation was unstable as was typified by large fluctuations in anode voltage, perhaps, due to the movement of emission sites between the different electride pieces, such that differing dominant sources of current might be reflected in the anode voltage because emission from an electride piece further upstream in the barrel would require higher voltage. It was also found that electride material that came in direct contact with the tantalum tube would convert to a non-conductive and non-emitting phase, which resulted in the cathode becoming more difficult to start and operate.

These problems were overcome by placing an electride sliver into a graphite liner that was subsequently placed inside the tantalum tube in the vicinity of the thoriated tungsten orifice plate or cap. After performing conditioning operations, which will be described in more detail hereinbelow, the cathode was found to start readily and operate stably. In the second embodiment, electride was formed within a graphite cup that was subsequently placed within a tantalum hollow cathode having an orifice. The sidewall of the tantalum tube was slightly crimped to prevent the graphite cup from moving within the tantalum tube, and to keep the electride near to the orifice plate, while permitting gas to flow between the interior surface of the tantalum tube and the outer surface of the graphite cup.

Reference will now be made in detail to the present embodiments of the invention, examples of which are illustrated in the accompanying drawings. In the FIGURES, similar structure will be identified using identical reference characters. It will be understood that the FIGURES are for the purpose of describing particular embodiments of the invention and are not intended to limit the invention thereto. Turning now to FIG. 1*a*, a schematic representation of a perspective side view of an embodiment of hollow cathode apparatus, 10, of the present invention, showing barrel, 12, fabricated from a 6.3 mm diameter cylindrical tantalum tube having circular thoriated tungsten orifice plate or cap, 14, with orifice, 15, having a thickness of 0.635 mm an orifice diameter of 0.76 mm, adapted to close off the downstream end thereof such that gas passes through orifice 15. Cap 14 may be welded to the top of barrel 12. Different orifice sizes have been used, and result in different operating conditions. The downstream 1.9 cm of the tantalum barrel was surrounded with 10 layers of radiation shielding, 16, fabricated from 0.0127 mm thick tantalum foil. As stated, unlike traditional cathodes, no heater was incorporated in the design.

As mentioned hereinabove, to maintain the electride in its conductive form, an anionic template, such as fine-grained EDM-3 graphite tube or liner, 18, having circumferential lip, 20, at circular end, 21, closest to orifice plate 14 and open at the other end, 22, thereof, was inserted into hollow cathode barrel 12. A single sliver of C12A7, 24, was placed in graphite liner 18 near the downstream end thereof. Liner 18 was 2.54 cm long with an inner diameter of 2.54 mm, an outer diameter of 5.08 mm. Lip 20, having an inner diameter of 1.905 mm, was found to keep electride 24 from contacting orifice plate 14. The largest effective diameter for lip 20 has not been investigated. Liner 18 was wrapped with single layer of tantalum foil, 26, to improve electrical contact and then inserted into a tantalum cathode barrel. Optionally, an electrical wire, 28, may be attached to tantalum foil 26 and directed upstream in tube 16 from graphite liner 18. Enclosed cylindrical keeper, 30, having 2.54 mm orifice, 32, in circular end-plate, 33, disposed 1.27 mm downstream from barrel orifice plate 14 was placed around cathode barrel 12. Gas source, 34, supplies chosen gases to barrel 12. In order to save gas, when it is desirable to pulse the cathode discharge on and off, gas source 34 may also be turned on and off. A circular flange, 37, or other attachment to keeper 30, permits keeper 30 to be mounted to chosen surfaces, as desired.

Figure 1B:
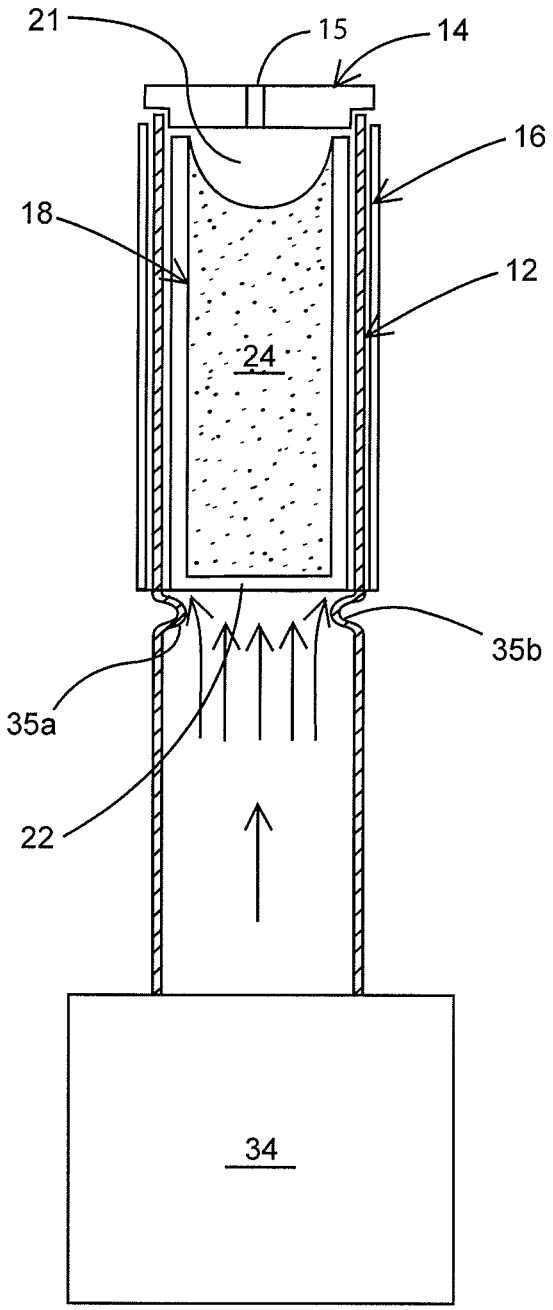
FIG. 1*b* shows a schematic representation of a side view of a second embodiment of the cathode barrel and graphite liner suitable for smaller hollow cathodes.

FIG. 1*b* is a schematic representation of a side view of a second embodiment of hollow cathode barrel 12 and liner 18. The keeper, insulator and mounting elements have been removed for clarity, but are necessary to complete the hollow cathode. Unlike liner 18 of FIG. 1*a*, which is open at bottom end 22, liner 18 in FIG. 1*b* has a closed bottom end 22 and an open downstream end, 21. Electride 24 is generated in a graphite cup having a graphite cap, in accordance with the procedure described in Section A, hereinabove. When the electride synthesis is complete, the cup is cut down in length such that its open end 21 is close to the level of electride material 24 formed in the cup, producing thereby liner 18. Because of the smaller diameter 3.5 mm) of liner 18, the surface tension of the electride both forms a concave meniscus in the region of the open end 21 of liner 18, and does not flow or migrate out of liner 18 when heated by the electric discharge, although open end 21 of liner 18 is placed close to orifice plate 14.

Tube 12 is dimpled in two or more locations, 35*a,b*, both to make electrical contact with insert 18, and to hold liner 18 within tube 12. Liner 18 has an outside diameter smaller than the inside diameter of tube 12, such that gas can pass around liner 18 and exit tube 12 through orifice 15 in orifice plate 14, and participate in the discharge.

Figure 2:
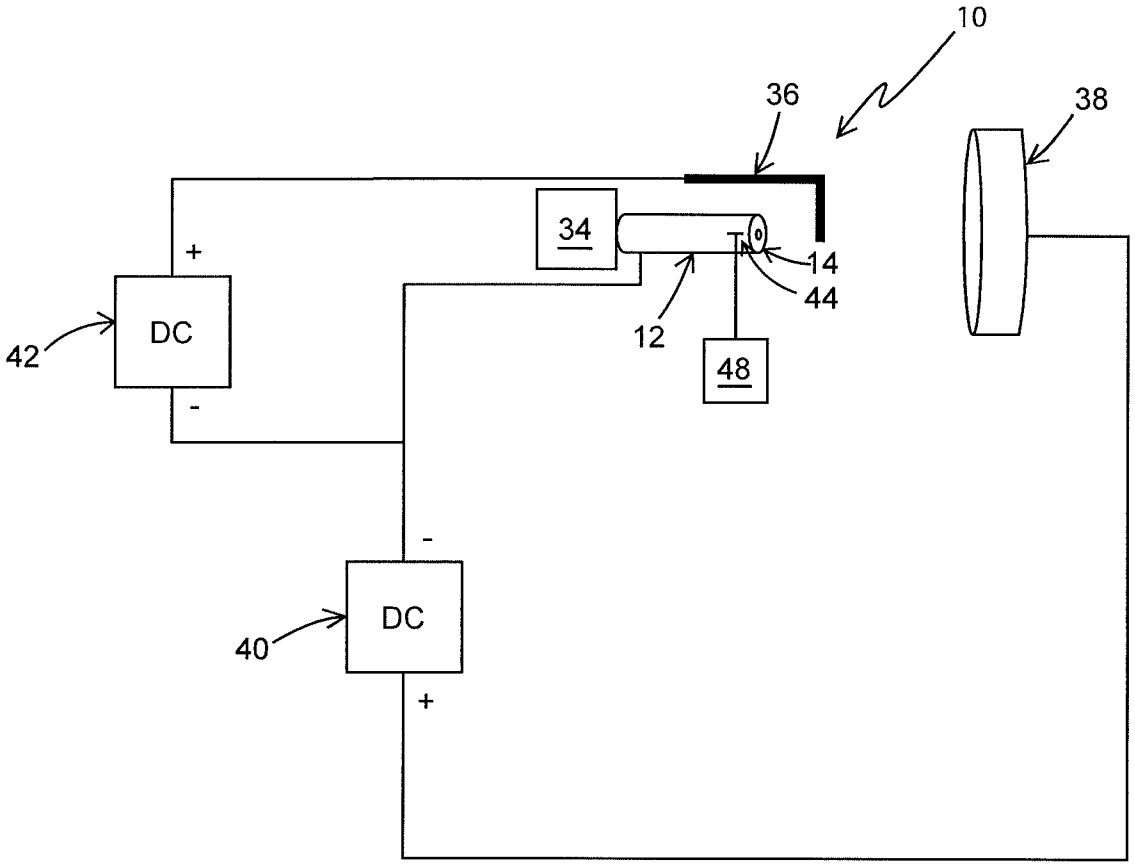
FIG. 2 is a schematic representation of a circuit employed for initiating and maintaining a discharge in the hollow cathode apparatus illustrated in FIG. 1, hereof, with the closed keeper being replaced with an external wire keeper.

FIG. 2 is a schematic representation of a circuit employed for initiating and maintaining a discharge in hollow cathode apparatus 10. An external tantalum wire keeper, 36, was occasionally used in place of closed keeper 30 for ease of access to the cathode and for viewing the discharge. The wire keeper was also used for preparing the cathode for regular service, as will be explained in more detail hereinbelow. In that configuration, the wire was bent into a circle approximately 6.3 mm in diameter, and placed approximately 1.27 mm downstream from orifice plate 14. Stainless steel ring anode, 38, having an outer diameter of 5 cm, a length of 24 cm, and a thickness of 0.38 mm, was disposed 3 cm from thoriated tungsten orifice plate 14 of hollow cathode discharge apparatus 10.

Shown also in FIG. 2 are direct current power supply, 40, for driving the discharge between cathode 12 and anode 38, and direct current keeper power supply, 42. As is described hereinbelow, these power supplies may be pulsed, having a chosen duty cycle. Anodes may be physical structures, such as the anode shown in FIG. 2, or a plasma, as examples. For the majority of cathode evaluation runs, open wire keeper 36 was used, since thermocouple, 44, could be mounted directly onto barrel 12 near orifice plate or cap 14 thereof to measure the operating temperature of the cathode using reader, 48. When enclosed graphite keeper 30 was installed, temperature was not measured.

Cathode testing was conducted in a diffusion pumped vacuum chamber, not shown in the FIGURES, having a base pressure of approximately $6\times10^{-6}$ Torr. The chamber pressure was $2\times10^{-5}$ Torr when about 4 sccm of xenon, a common mass flow rate used to test the hollow cathodes, was introduced into barrel 12 from gas source 34.

Unlike traditional cathodes, the discharge start-up procedure does not involve a lengthy conditioning or heat-up process. There were two procedures by which the discharge electride cathode was initiated. One involved setting the mass flow rate and increasing the keeper voltage until a discharge was initiated by an arc discharge between keeper 30 or 36 and cathode barrel 12, which ignited the cathode discharge. With 50 sccm of xenon flowing, the discharge typically started with 400 V on keeper 30 or 36. Alternatively, a high voltage could be applied to keeper 30 or 36, while the mass flow rate was increased until the cathode started. With 1000 V on the keeper, the discharge commenced with approximately 25 sccm of xenon. The later procedure was used more frequently to conserve gas. At startup, the cathode immediately coupled to the anode to within the response time of the display on the power supply which was less than about 0.2 s. It should be mentioned that unsuccessful attempts were made using these start-up procedures on an identical cathode without the electride/graphite liner insert. The ignition time of less than about 0.2 s is useful for operating the cathode in pulse mode. As an illustrative example, one could operate the cathode for a period of time on the order of seconds followed by the discharge and flow rate being "off" for a chosen period of time. In this way one could set the pulse repetition frequency to a value on the order of one Hertz, and vary the duty cycle from a few percent to greater than 50%.

Figure 3:
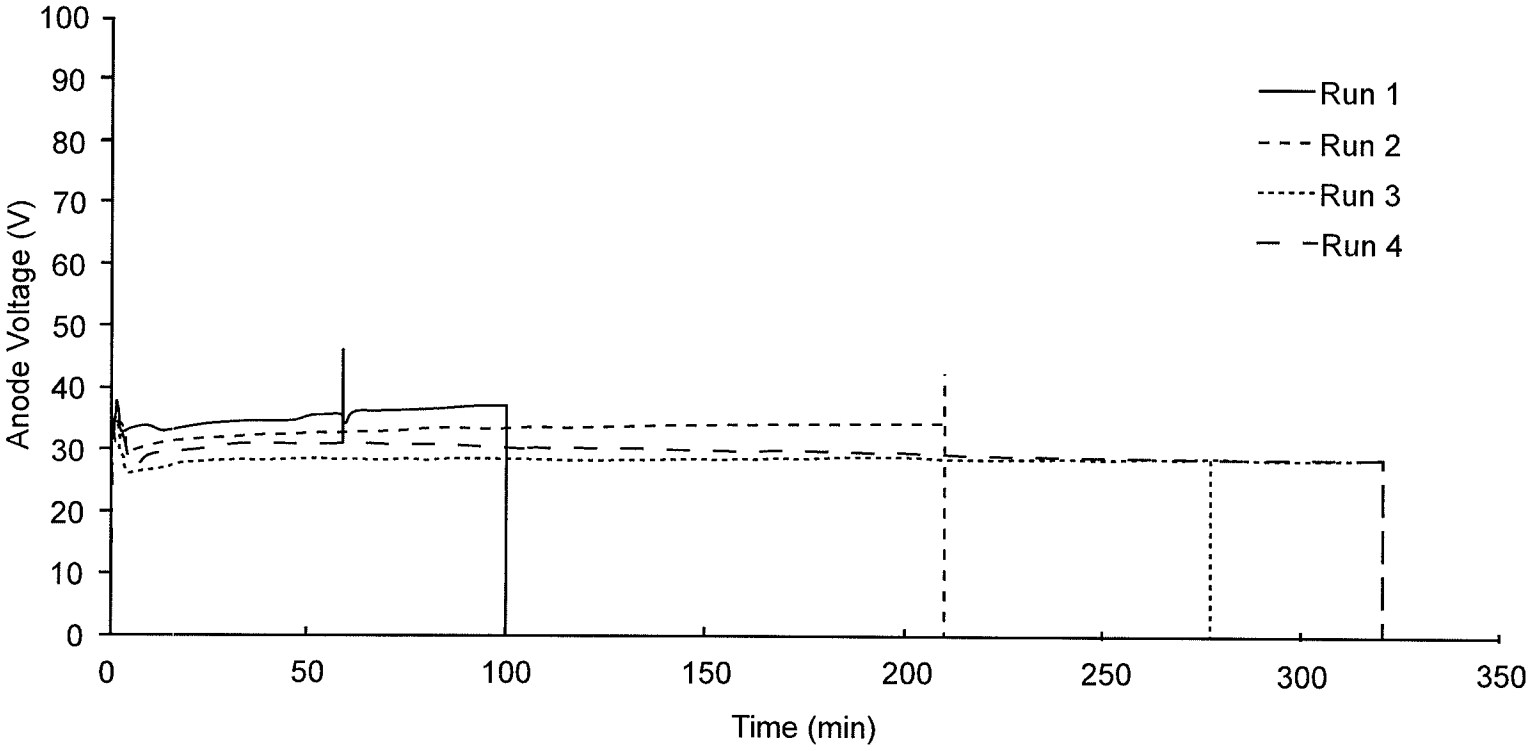
FIG. 3 is a graph of the anode voltage as a function of time over the course of four runs during the preparation of an insert.
Figure 4:
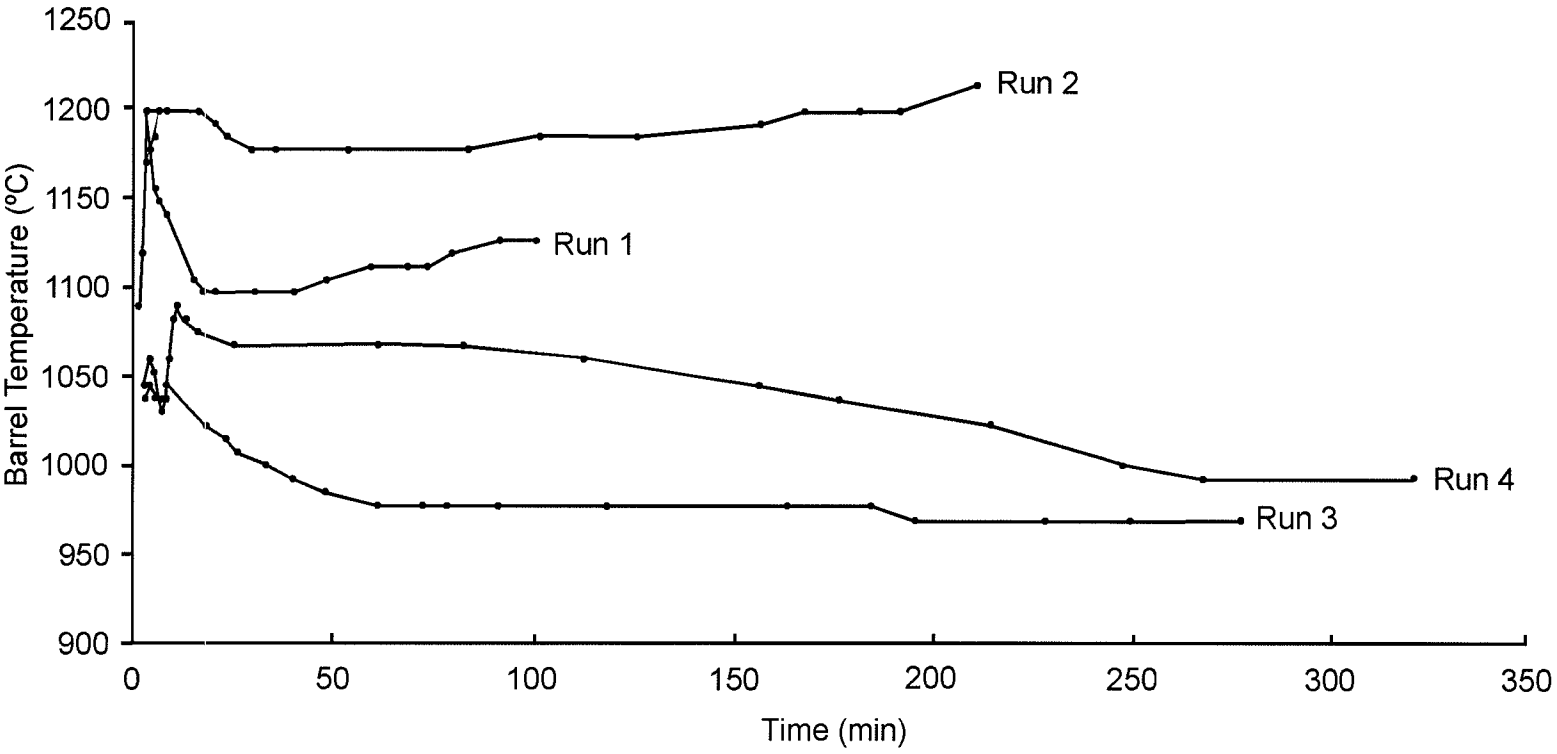
FIG. 4 is a graph of the barrel temperature as a function of time over the course of four runs during the preparation of an insert.

Reproducible cathode operation is defined as duplicated anode voltages and barrel temperatures at a given set point. For the following data, reproducible operation was defined as an anode voltage constant and repeatable within ±3 V, and an operating temperature constant and repeatable within ±50° C. It was found that the first two or three times an insert was operated, the cathode generally exhibited initially high and decreasing anode voltages and barrel temperatures. After three or four runs, the anode voltages and barrel temperatures at different set points became approximately constant. FIGS. 3 and 4, respectively, illustrate this progression for a single insert over the course of four runs, and operation was deemed reproducible between the third and fourth run. The abrupt shutdown at the end of conditioning runs 1, 2 and 3 were followed by a time period sufficient to return the cathode to about room temperature. This time period was typically 2-3 h, but occasionally as long as 16 h if the shutdown occurred at the end of the day. The conditioning run following an abrupt shutdown and cool down time resulted in lower temperatures and anode voltages on the subsequent run that were not possible to achieve without the abrupt shutdown and cool down process.

Following the above operations, it was found that relatively low voltage on keeper 30, 36 was required to start the electride cathode and there was no visible arc activity observed. The cathode did not appear to require an arcing event on the orifice to initiate operation, and the applied voltage on the keeper was not adequate to cause arcing between the cathode and keeper orifices. Of significance is that the C12A7 electride, which has a low work function, appears to emit a sufficient number of electrons at room temperature to trigger the discharge initiation sequence that quickly transitions into the desired and sustained arc discharge between the electride inside the cathode and the externally located electrodes.

As seen from FIG. 4, operating temperatures as low as 975° C. were measured on the outer surface of the downstream end of the cathode barrel. Under some operating conditions, temperatures of about 650° C. were measured. After an initial stabilization process, the operation leveled out to within a tenth of a volt on the current-limited anode, and was repeatable to within a few volts during subsequent operations (over a two month period, with 20 cathode restarts, 11 chamber vent-pump-down sequences, and an iodine exposure in which 0.1 g of iodine was flowed through the tantalum barrel at room temperature). An electride insert has operated for more than 60 h, with no observed degradation. Additionally, there appeared to be no detrimental effects when an insert was left in the ambient atmosphere for several weeks prior to operating in the cathode.

Barrel temperatures of about 650° C. were measured at discharge currents of approximately 1.5 A with a xenon mass flow rate of about 4 sccm with orifice 15 having sizes of approximately 0.76 mm, 1.42 mm and 2.03 mm. It is anticipated that metals, such as titanium, nickel and steel, and alloys thereof, may be useful for cathode barrels at such low temperatures. Currently, tantalum, molybdenum and tungsten, and alloys thereof, are used in hollow cathodes Having generally described the invention, the following EXAMPLES provide greater detail.

EXAMPLE 1

Iodine has recently attracted interest as an alternative electric propulsion propellant, since it can be stored in low pressure tanks in the solid phase, eliminating the need for the large, high pressure storage solutions mandated by xenon. Iodine has an atomic mass similar to that of xenon with slightly larger ionization cross-sections (for both 1 and $I_2$). The increased reactivity of iodine when compared to xenon was a concern, especially when the susceptibility to contamination of Ba—W hollow cathodes was considered; however the electride hollow cathode of the present invention has been observed to be resistant to contamination.

The iodine feed system to the cathode incorporated a heated iodine reservoir with a pressure transducer that could be used to quantify the approximate flow rate. All tubing between the reservoir and the cathode were heated to prevent iodine condensation. The reservoir was weighed after each day of operation, allowing for the development of a flow rate calibration curve from the measured reservoir pressure.

The cathode was tested in the diode configuration with a ring anode and enclosed graphite keeper described hereinabove, the constant 0.3 A of current collected by the keeper being added to the discharge current. The cathode discharge was initiated with iodine at room temperature with no heater. Almost 20 hours of operation with iodine was accumulated on a single C12A7 electride insert with no observable electride degradation or contamination. The 20-hour duration involved eight restarts from room temperature as well as an exposure to atmosphere; no difficulty starting and operating the cathode was encountered. However, a black discoloration was observed on the outer surface of the tantalum cathode barrel, and the tantalum radiation shielding was also discolored and damaged, likely due to iodine reacting with the cathode structure materials to form iodine compounds. Tantalum is known to react with iodine to form tantalum pentaiodide ($TaI_5$) above about 300° C. Using refractory metals such as tungsten or molybdenum for the barrel and radiation shielding material would most likely not prevent corrosion, as they react with iodine at elevated temperatures.

A graphite barrel with flexible graphite or platinum radiation shielding might be used to overcome this problem. Graphite adsorbs and desorbs iodine with temperature fluctuations, but will not corrode or react. The cathode barrel and orifice plate could be fabricated from graphite, and the downstream end of the orifice plate covered with a platinum plate, which would prevent arcs from occurring between the graphite and the keeper during discharge initiation. Graphite erodes quickly and deforms into peaks and tendrils when subjected to arcing. Platinum will eventually corrode in the presence of iodine, although at a rate more than 150 times slower than that of tantalum. Alternatively, a graphite orifice plate might be used with a keeper power supply that incorporates arc suppression circuitry to avoid damage to the graphite.

Figure 5:
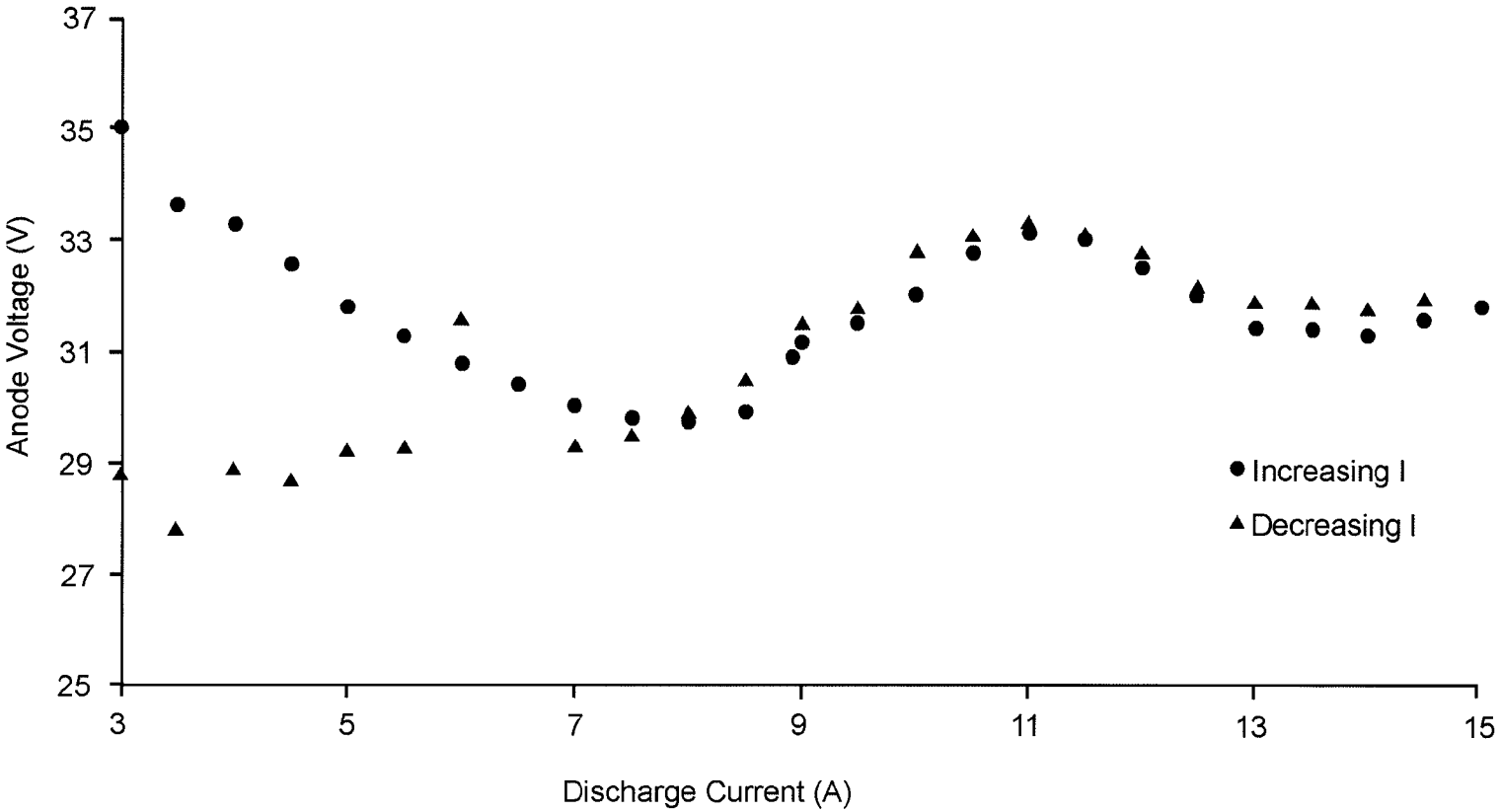
FIG. 5 is a graph of the anode voltage as a function of discharge current for an electride hollow cathode with an iodine propellant at a constant flow rate of 13 sccm.
Figure 6:
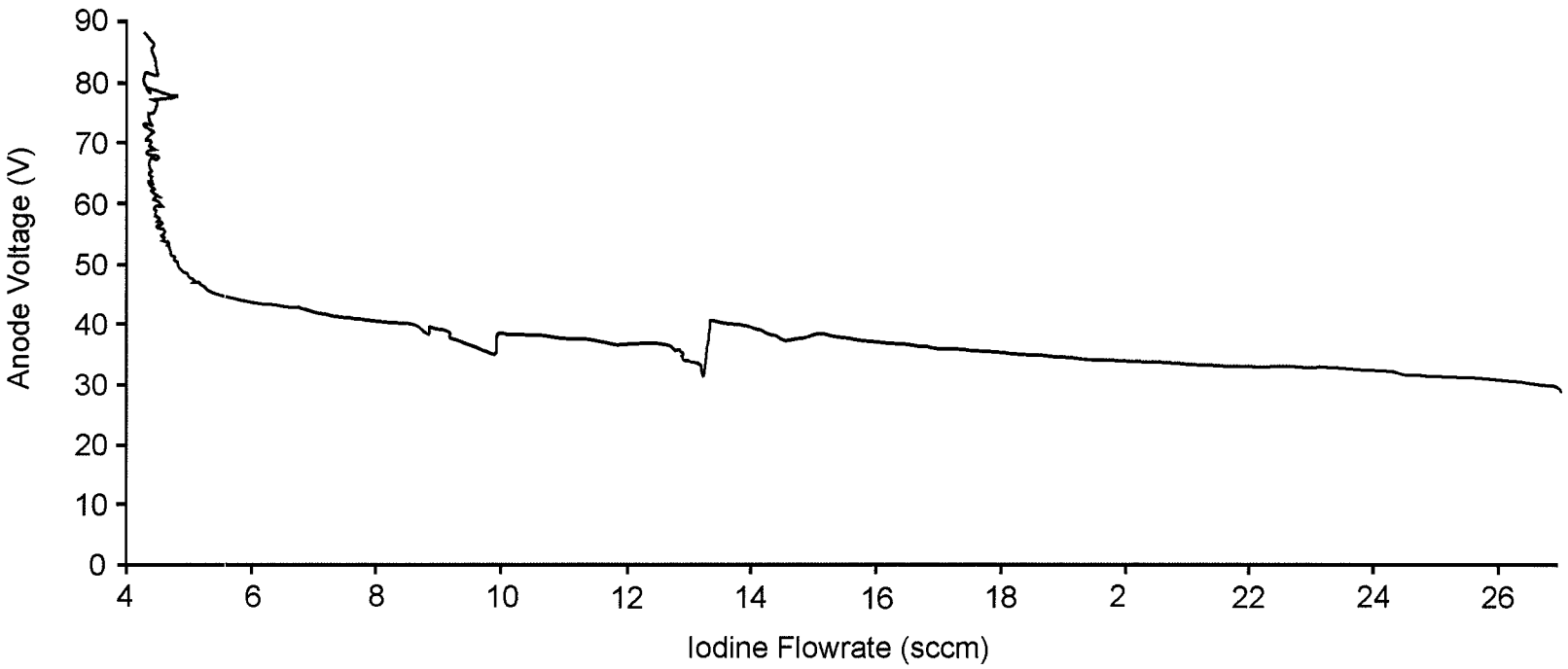
FIG. 6 is a graph of the anode voltage as a function of mass flow rate for an electride hollow cathode with an iodine propellant.

The anode voltage as a function of discharge current was measured at a constant iodine flow rate of approximately 13 sccm. Data were recorded as the current was increased from 3 A to 15 A, and decreased from 15 A to 3 A over approximately one hour, and are shown in FIG. 5. The cathode performance at lower iodine flow rates was also investigated by slowly decreasing the temperature of the iodine reservoir in the feed system while the anode voltage was recorded, as shown in FIG. 6. The discharge current was kept constant at 3 A with an additional 0.3 A collected by the keeper. The internal pressure of the cathode was estimated to be approximately one Torr; consequently, there is uncertainty regarding flow rate, especially at flow rates near 5 sccm where the increase in anode voltage was observed. It is believed that the actual flow rate is lower than 5 sccm, because cathode operation using xenon shows an increase in anode voltage at flow rates close to 1 sccm at a discharge current of 3 A.

EXAMPLE 2

Neutral Confinement Cylinder (NCC)

Figure 7:
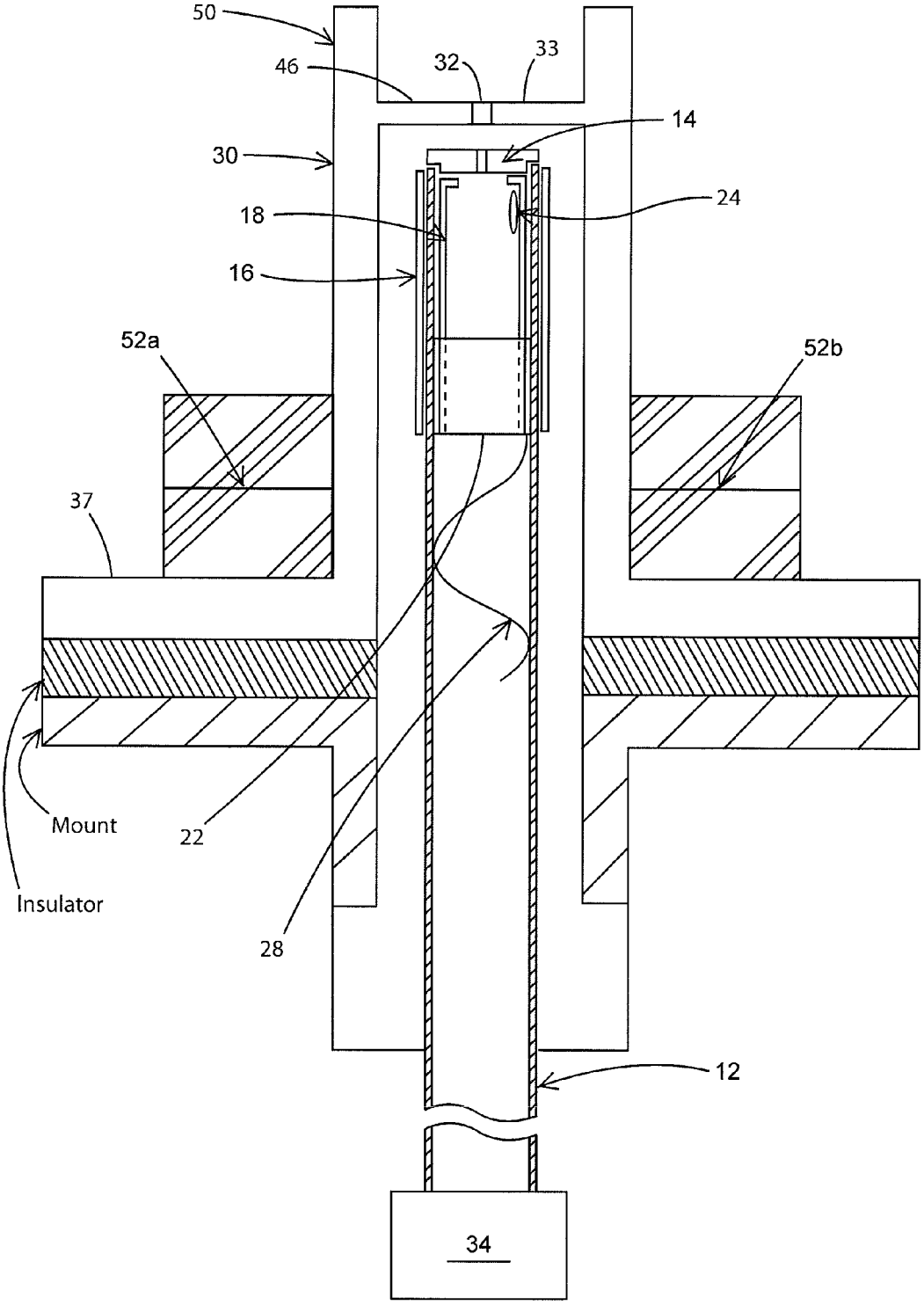
FIG. 7 is a schematic representation of a side view of the apparatus illustrated in FIG. 1, hereof, illustrating the addition of a neutral confinement cylinder and permanent magnets for generating an axial magnetic field.
Figure 8:
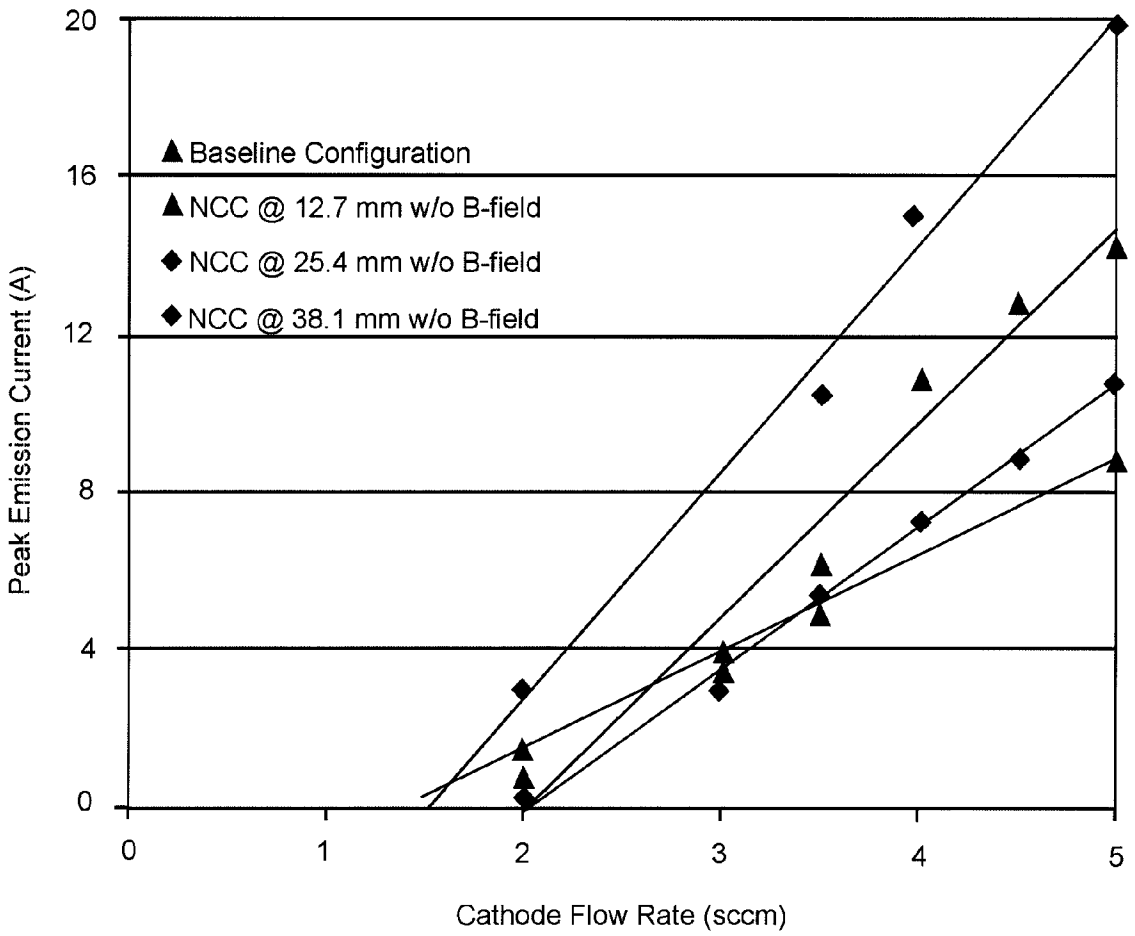
FIG. 8 is a graph of the peak emission current of the cathode as a function of flow rate for different cylinder lengths, compared to the baseline configuration without the cylindrical extension.

Improved confinement of the cathode neutrals which normally escape away from the keeper orifice was observed by wrapping a stainless steel foil around the graphite keeper, thereby creating a cylindrical extension, 50, downstream of keeper face, 46, as illustrated in FIG. 7. Cylinder 50 was extended 12.7, 25.4, and 38.1 mm downstream of keeper face 46, and was biased to keeper 30, which had an outer diameter of 30.5 mm. FIG. 8 is a graph of the peak emission current as a function of flow rate for the identified lengths of cylinder 50, compared to the baseline configuration without the cylindrical extension. The peak emission current is determined based on the maximum operating current measured before the voltage begins to increase. The optimum length was found to be 25.4 mm, with longer extensions perhaps leading to excessive ion collection on the NCC surface. From this, the optimum length of the cylinder is approximately 83% of the keeper diameter. It should be mentioned that the NCC may also be formed integral with the graphite keeper, or otherwise attached to the downstream end thereof.

EXAMPLE 3

Impact of Applied Magnetic Field

It is known that stray magnetic fields (a few Gauss) can adversely affect the cathode coupling process, and that the elimination of these stray fields can reduce the coupling voltage for a given flow rate. An axial magnetic field provides an improved "highway" for the electrons to reach the chamber walls. As the magnetic field strength is increased the plasma becomes more collimated. In order to investigate the effects of an applied axial magnetic field on the cathode electron emission characteristics, samarium-cobalt magnets, 52, were used to generate an axial magnetic field at the keeper face, as illustrated in FIG. 7. Three field strengths were tested: 75, 100, and 150 Gauss. Permanent magnets 52 were stacked around the base of the keeper in four stacks with four magnets per stack. This generated 100 Gauss at the keeper face, with field lines being aligned with the orifice and slowly diverging in the downstream region. Clearly, other types of permanent magnets can be employed in various configurations, to achieve similar results. Electromagnets have also been used with similar results.

Figure 9:
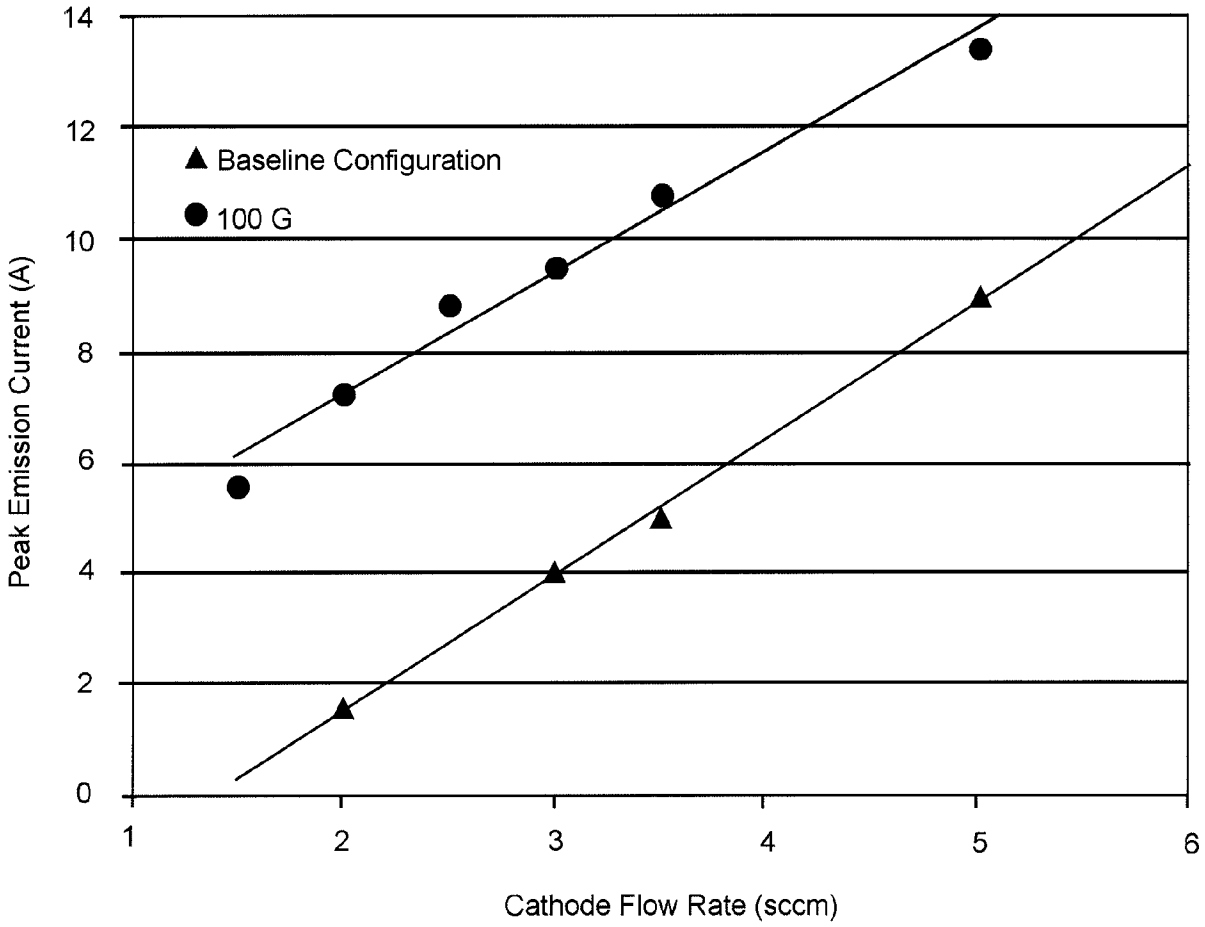
FIG. 9 is a graph of the increase in peak emission current when an axial magnetic field is applied, compared with a baseline configuration without magnetic fields.

The required keeper voltage for cathode ignition was found to be reduced with the application of an axial magnetic field. Further increases in magnetic field above 100 Gauss provided limited improvement. The 100 Gauss configuration was chosen as a compromise between maximum current emission and system mass. The total weight of the magnets to generate 100 Gauss was 0.13 kg. Voltage-Current curves were measured at various flow rates to determine the impact of an applied magnetic field on the electron emission capability of the cathode. In addition to the significant improvement in maximum electron emission for a given flow, the discharge voltage has been found to be reduced, indicating easier extraction of the cathode electrons. FIG. 9 is a graph of the peak emission current increase when going from the baseline configuration to the applied magnetic field configuration. As may be observed from FIG. 9, the emission current increases for all flow rates tested. While the applied magnetic field improves the electron emission capability for all flow rates, use of the NCC favors higher flow rates with minimal improvement below about 2 sccm.

EXAMPLE 4

Magnetic Field+Neutral Confinement Cylinder Combination

Figure 10:
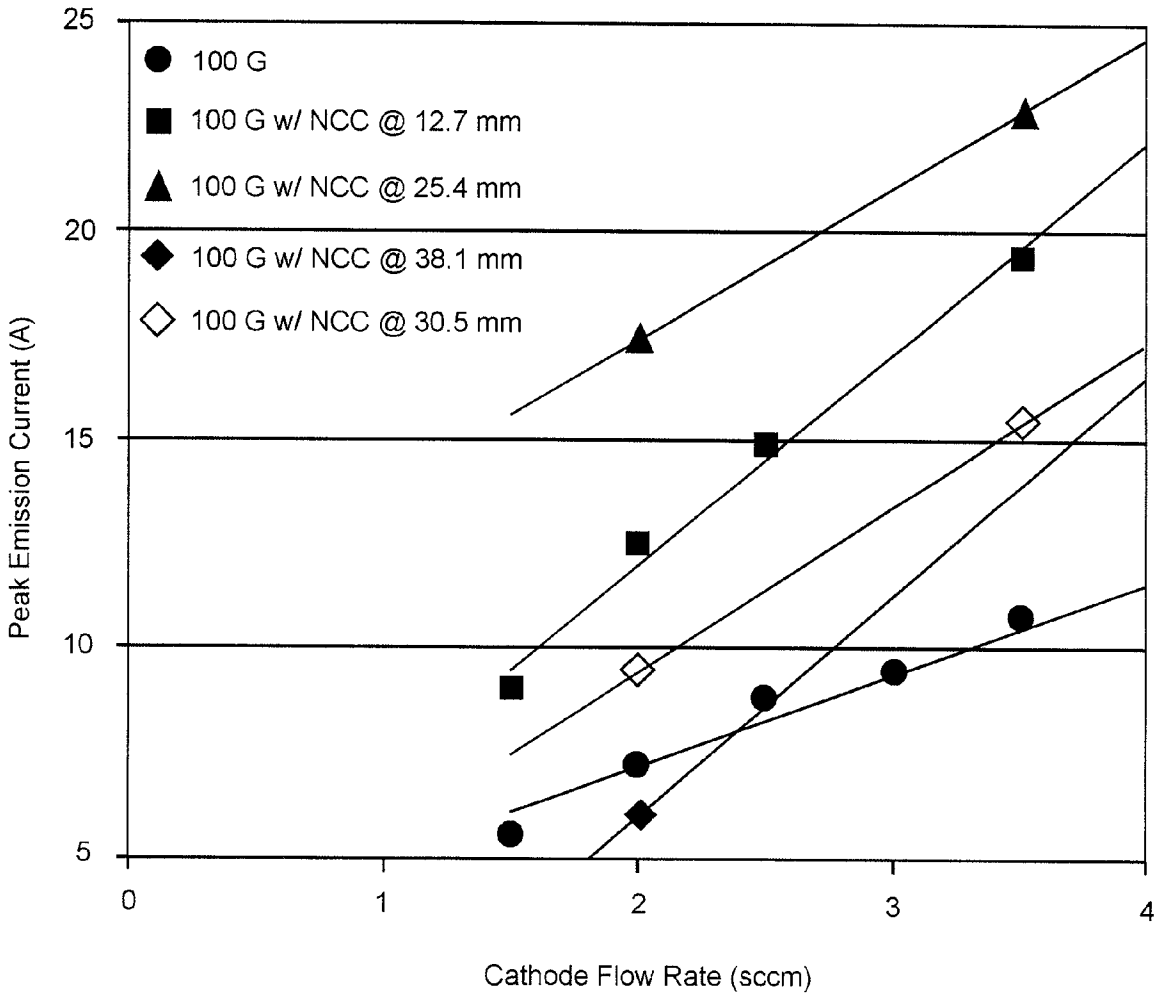
FIG. 10 is a graph of the peak emission current capability of the cathode with an axial field strength of 100 Gauss and the neutral confinement cylinder at various positions relative to the downstream face of the keeper.

FIG. 10 is a graph of the peak emission current capability of the cathode with an axial field strength of 100 Gauss and various lengths of the NCC. The optimum length was found to be about 25.4 mm. The improvement observed when combining the two configurations (B-field and NCC) is approximately the sum of their individual improvements discussed hereinabove. The slopes of the trend lines for the various NCC lengths with the 100 Gauss field strength lies between the slopes of the standalone B-field configuration and the stand alone NCC configuration. It should be noted that with the NCC having a length of 30.5 mm and a diameter matching that of the keeper diameter, results in a sharp drop in emission current capability compared to a length of 25.4 mm.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A hollow cathode discharge apparatus, comprising:

a metal tube having a first end and a second end, an outside surface and an inside surface;

a gas source for flowing gas into the first end of said tube;

a metal end cap having an orifice with a chosen diameter adapted to attach to the second end of said tube, such that the gas exits said tube through the orifice;

a tubular graphite liner having an outer surface, a first open end and a second end, adapted to be inserted into said metal tube, and in electrical contact therewith, with the second end thereof disposed in the vicinity of said end cap;

a $12CaO\text{-}7Al_2O_3$ electride material disposed inside of said tubular graphite liner in the vicinity of said metal end cap;

a keeper element disposed outside of said tube in the vicinity of said end cap; and a first direct current source in electrical contact with said keeper and said tube for initiating and maintaining an electric discharge in the gas between said electride material and said keeper without said electride material being initially heated.

2. The discharge apparatus of claim 1, further comprising an electrode or plasma anode disposed outside of said keeper; and a second direct current source for initiating and maintaining an electric discharge in the gas between said electride material and said anode.

3. The discharge apparatus of claim 1, wherein said first direct current source is pulsed on and off.

4. The discharge apparatus of claim 3, wherein said gas source is pulsed on and off in synchronization with the on and off condition of said first direct current source.

5. The discharge apparatus of claim 1, wherein said metal tube is chosen from tantalum, tungsten and molybdenum, and alloys thereof.

6. The discharge apparatus of claim 1, wherein said metal tube is chosen from titanium, nickel and steel, and alloys thereof.

7. The discharge apparatus of claim 1, wherein said gas comprises xenon.

8. The discharge apparatus of claim 1, wherein said metal end cap is chosen from tantalum, tungsten, and molybdenum, and alloys thereof.

9. The discharge apparatus of claim 8, wherein said metal cap comprises thoriated tungsten.

10. The discharge apparatus of claim 1, wherein said metal end cap is welded to said metal tube.

11. The discharge apparatus of claim 1, further comprising a heat shield on the outside surface of said metal tube.

12. The discharge apparatus of claim 1, wherein the second end of said graphite insert has a circumferential graphite lip.

13. The discharge apparatus of claim 1, wherein said keeper comprises a wire keeper.

14. The discharge apparatus of claim 1, wherein said keeper comprises a cylindrical graphite keeper having an orifice, a chosen outer diameter, and an outer face, enclosing a portion of said tube in the region of said end cap.

15. The discharge apparatus of claim 14, further comprising a conducting cylinder having a chosen length and an inner diameter equal to the outer diameter of said graphite keeper, in electrical contact with said keeper for extending the length of said graphite keeper from the outer face thereof, thereby preventing gas molecules from expanding at high zenith angles from the orifice of said keeper.

16. The discharge apparatus of claim 1, further comprising at least one magnet or electromagnet for generating an axial magnetic field in the region of the orifice of said keeper.

17. The discharge apparatus of claim 15, further comprising at least one magnet or electromagnet for generating an axial magnetic field in the region of the orifice of said keeper.

18. The discharge apparatus of claim 1, further comprising a metal foil wrapped around the outside surface of said graphite liner for providing electrical contact between said tube and said graphite liner.

19. A hollow cathode discharge apparatus, comprising:

a metal tube having a first end and a second end, an outside surface and an inside surface;

a gas source for flowing gas into the first end of said tube;

a metal end cap having an orifice with a chosen diameter adapted to attach to the second end of said tube, such that the gas exits said tube through the orifice;

a tubular graphite insert having a first close end and a second open end adapted to be inserted into said metal tube such that gas can flow between said graphite insert and the inside surface of said metal tube, the second end of said insert being disposed in the vicinity of said end cap;

wherein said metal tube is dimpled in the region of the first end of said graphite insert for holding said insert in position in said tube, and for making electrical contact therewith;

a $12CaO\text{-}7Al_2O_3$ electride material generated in said tubular graphite insert and filling said insert to about the second end thereof;

a keeper element disposed outside of said tube in the vicinity of said end cap; and a first direct current source in electrical contact with said keeper and said tube for initiating and maintaining an electric discharge in the gas between said electride material and said keeper without said electride material being initially heated.

20. The discharge apparatus of claim 19, further comprising an electrode or plasma anode disposed outside of said keeper; and a second direct current source for initiating and maintaining an electric discharge in the gas between said electride material and said anode.

21. The discharge apparatus of claim 19, wherein said first direct current source is pulsed on and off.

22. The discharge apparatus of claim 21, wherein said gas source is pulsed on and off in synchronization with the on and off condition of said first direct current source.

23. The discharge apparatus of claim 19, wherein said metal tube is chosen from tantalum, tungsten and molybdenum, and alloys thereof.

24. The discharge apparatus of claim 19, wherein said metal tube is chosen from titanium, nickel and steel, and alloys thereof.

25. The discharge apparatus of claim 19, wherein said gas comprises xenon.

26. The discharge apparatus of claim 19, wherein said metal end cap is chosen from tantalum, tungsten, and molybdenum, and alloys thereof.

27. The discharge apparatus of claim 26, wherein said metal cap comprises thoriated tungsten.

28. The discharge apparatus of claim 19, wherein said metal end cap is welded to said metal tube.

29. The discharge apparatus of claim 19, further comprising a heat shield on the outside surface of said metal tube.

30. The discharge apparatus of claim 19, wherein the second end of said graphite insert has a circumferential graphite lip.

31. The discharge apparatus of claim 19, wherein said keeper comprises a wire keeper.

32. The discharge apparatus of claim 19, wherein said keeper comprises a cylindrical graphite keeper having an orifice, a chosen outer diameter, and an outer face, enclosing a portion of said tube in the region of said end cap.

33. The discharge apparatus of claim 32, further comprising a conducting cylinder having a chosen length and an inner diameter equal to the outer diameter of said graphite keeper, in electrical contact with said keeper for extending the length of said graphite keeper from the outer face thereof, thereby preventing gas molecules from expanding at high zenith angles from the orifice of said keeper.

34. The discharge apparatus of claim 19, further comprising at least one magnet or electromagnet for generating an axial magnetic field in the region of the orifice of said keeper.

35. The discharge apparatus of claim 33, further comprising at least one magnet or electromagnet for generating an axial magnetic field in the region of the orifice of said keeper.

* * * * *